US009416749B2

(12) United States Patent
Maki et al.

(10) Patent No.: US 9,416,749 B2
(45) Date of Patent: Aug. 16, 2016

(54) ENGINE HAVING COMPOSITE CYLINDER BLOCK

(71) Applicant: Ford Global Technologies, LLC, Dearborn, MI (US)

(72) Inventors: Clifford E. Maki, New Hudson, MI (US); Rick L. Williams, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 106 days.

(21) Appl. No.: 14/101,199

(22) Filed: Dec. 9, 2013

(65) Prior Publication Data

US 2015/0159581 A1 Jun. 11, 2015

(51) Int. Cl.

| | |
|---|---|
| ***F02F 7/00*** | (2006.01) |
| ***F02F 1/18*** | (2006.01) |
| ***F02F 1/00*** | (2006.01) |
| ***F02F 1/10*** | (2006.01) |

(52) U.S. Cl.

CPC . *F02F 1/18* (2013.01); *F02F 1/004* (2013.01); *F02F 1/10* (2013.01); *F02F 1/102* (2013.01); *F02F 1/108* (2013.01); *F02F 7/0007* (2013.01); *F02F 2200/06* (2013.01); *F05C 2253/04* (2013.01)

(58) Field of Classification Search

CPC ..... F02F 1/004; F02F 1/02; F02F 1/045; F02F 1/11; F02F 1/102; F02F 1/108; F02F 1/16; F02F 1/153

USPC ..... 123/193.2, 41.84, 41.32, 195 R

See application file for complete search history.

(56) References Cited

U.S. PATENT DOCUMENTS

| | | | | | |
|---|---|---|---|---|---|
| 1,643,645 | A | * | 9/1927 | Strand | 123/41.84 |
| 1,765,230 | A | * | 6/1930 | Guernsey | 123/41.32 |
| 3,090,368 | A | * | 5/1963 | Buchwald | 123/90.25 |
| 4,244,330 | A | * | 1/1981 | Baugh et al. | 123/41.84 |
| 4,473,042 | A | | 9/1984 | Kikuchi | |
| 4,562,799 | A | * | 1/1986 | Woods et al. | 123/193.2 |

(Continued)

FOREIGN PATENT DOCUMENTS

| | | | |
|---|---|---|---|
| CN | 1718374 | A | 1/2006 |
| CN | 1745238 | A | 3/2006 |

(Continued)

OTHER PUBLICATIONS

Fujine, Manabu et al., "Development of Metal Matrix Composite for Cylinder Block," Seoul 2000 FISITA World Automotive Congress, Paper No. F2000A065, Seoul, Korea, Jun. 12-15, 2000, 5 pages.

(Continued)

*Primary Examiner* — Marguerite McMahon

(74) *Attorney, Agent, or Firm* — Greg Brown; Alleman Hall McCoy Russell & Tuttle LLP

(57) ABSTRACT

An engine is provided. The engine includes a thermo-molded composite cylinder block including a front engine cover attachment interface and a transmission attachment interface. The engine further includes a cylinder liner comprising a different material than a composite cylinder block and integrally molded with the composite cylinder block, the cylinder liner defining a portion of a boundary of a cylinder and including a top deck at least partially extending across a water jacket cavity surrounding the cylinder.

11 Claims, 7 Drawing Sheets

(56) References Cited

U.S. PATENT DOCUMENTS

| | | | | |
|---|---|---|---|---|
| 4,700,444 | A | 10/1987 | Yamagata | |
| 4,922,870 | A | 5/1990 | Pietsch et al. | |
| 5,086,733 | A * | 2/1992 | Inoue et al. | 123/41.84 |
| 5,357,921 | A | 10/1994 | Katoh et al. | |
| 5,370,087 | A | 12/1994 | Guimond et al. | |
| 5,687,634 | A | 11/1997 | Ransone | |
| 5,727,511 | A | 3/1998 | Omura et al. | |
| 6,308,680 | B1 | 10/2001 | Prior | |
| 7,322,320 | B2 | 1/2008 | Sugano | |
| 8,327,817 | B2 | 12/2012 | Palazzolo et al. | |
| 2005/0173091 | A1 | 8/2005 | Cantu-Gonzalez et al. | |
| 2006/0037566 | A1 * | 2/2006 | Sugano | 123/41.74 |
| 2006/0086327 | A1 | 4/2006 | Flynn et al. | |
| 2006/0102110 | A1 | 5/2006 | Takenaka et al. | |
| 2014/0261285 | A1 * | 9/2014 | Williams et al. | 123/195 R |

FOREIGN PATENT DOCUMENTS

| | | | |
|---|---|---|---|
| EP | 0494532 | A1 | 12/1991 |
| EP | 1457658 | A2 | 9/2004 |
| EP | 1681454 | A2 | 7/2006 |
| EP | 1843029 | A2 | 10/2007 |

OTHER PUBLICATIONS

Lenny, John Jr., "Replacing the Cast Iron Liners for Aluminum Engine Cylinder Blocks: A Comparative Assessment of Potential Candidates," Engineering Thesis Submitted to Graduate Faculty of Rensselaer Polytechnic Institute, Hartford, Connecticut, Apr. 2011, 66 pages.

Williams, Rick L. et al., "Engine Having Composite Cylinder Block," U.S. Appl. No. 14/101,213, filed Dec. 9, 2013, 23 pages.

* cited by examiner

ENGINE HAVING COMPOSITE CYLINDER BLOCK

FIELD

The present disclosure relates to an engine having a thermal-molded composite cylinder block and cylinder liners integrated into the cylinder block.

BACKGROUND AND SUMMARY

Engine cylinders are typically formed by attaching cylinder heads to cylinder blocks. In engine design there are trade-offs between strength, weight, and other material properties of materials used to construct the cylinder head and block. For example, iron has been used to manufacture cylinder blocks. Cast iron may have several benefits over other materials such as a smaller volume to strength ratio and a smaller friction coefficient, decreasing the engine's size and combustion chamber wear. However, cast iron cylinder blocks may have a low strength to weight ratio, is more susceptible to corrosion, and has undesirable heat transfer characteristics. To reduce weight and increase heat transfer to water jackets, cylinder block may be cast out of aluminum. However, aluminum cylinder blocks have several drawbacks, such as high friction coefficients and larger volume to strength ratios.

U.S. Pat. No. 5,370,087 discloses an engine having a composite cylinder case enclosing metal cylinder banks. The inventors have recognized several disadvantages with the cylinder block disclosed in U.S. Pat. No. 5,370,087. Firstly, the cylinder case enclosing the cylinder banks is spaced away from the cylinder banks to enable coolant to flow around the cylinders. This type of arrangement decreases the structural integrity of the engine when compared to engines cast via a single continuous piece of metal. Therefore, forces transferred to the engine via external components, such as the transmission, may damage the cylinder case. As a result, the longevity of the engine is decreased.

The inventors herein have recognized the above issues and developed an engine. The engine includes a thermo-molded composite cylinder block including a front engine cover attachment interface and a transmission attachment interface. The engine further includes a cylinder liner comprising a different material than a composite cylinder block and integrally molded with the composite cylinder block, the cylinder liner defining a portion of a boundary of a cylinder and including a top deck at least partially extending across a water jacket cavity surrounding the cylinder.

In this way, a composite material integrally molded with a cylinder liner may be used to form a portion of the engine to increase the engine's strength to weight ratio. Furthermore, the cylinder liner may comprise a metal or other suitable material having more desirable abrasion and heat transfer characteristics around the combustion chambers. In this way, selected portions of the cylinder block may be designed with different materials to increase the engine's strength to weight ratio without compromising desired combustion chamber characteristics. Moreover, integrally molding the cylinder liner with the cylinder block increases the coupling strength of the block assembly.

The cylinder liner may include various structural features providing greater coupling strength between the cylinder liner and cylinder block. For example, the liner may include a block attachment recess in a top deck of the cylinder liner as well as a block attachment lip extending around a peripheral surface of the liner. The contours of these features provide a greater amount of bonding strength between the thermo-molded composite cylinder block and the cylinder liner during molding. Additionally, the top deck may include openings in fluidic communication with a water jacket cavity. The openings enable a filler material, such as wax, to flow out of the mold during manufacturing. In this way, the water jacket cavity may be formed during manufacturing. Additionally, the openings in the top deck also enable vapor to escape the cylinder block water jacket during engine operation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

FIGS. 2-6 are drawn approximately to scale, however other relative dimensions may be utilized if desired.

DETAILED DESCRIPTION

An engine having a composite cylinder block with an integrally molded cylinder liner defining the boundary of at least one cylinder described herein. The cylinder liner may be constructed out of a metallic material while the cylinder block may be constructed out of a thermal-set or thermo-molded composite material, such as a polymeric material, carbon fiber, etc. In this way, a material having a high strength to weight ratio may be used to construct the block surrounding the cylinder liner. Therefore, a desired structural integrity of the block may be maintained while decreasing the weight of the block or the structural integrity of the block may be increased without increasing the block's weight. Furthermore, providing an integrally molded metallic cylinder liner in the composite cylinder block enables a different material better suited to handle the heat and pressure generated via combustion to be used for the combustion chambers. In this way, the characteristics of various sections of the engine can be tuned based on desired engine operating characteristics. Consequently, the engine's strength to weight ratio is increased without compromising the combustion chamber's abrasion and heat transfer characteristics.

The cylinder liner may be includes various structural characteristics which provide greater coupling strength between the cylinder liner and the block. For instance, the cylinder liner may include a block attachment lip extending around a peripheral surface of the liner as well as a block attachment recess in a top deck of the cylinder liner. The contours of these features provide a greater amount of bonding strength between the thermo-molded composite cylinder block and the cylinder liner during molding. Additionally, the top deck may include openings in fluidic communication with a water jacket cavity. The openings enable a filler material, such as wax, to flow out of the mold during manufacturing. In this way, the water jacket cavity may be easily formed during manufacturing. Additionally, the openings in the top deck also enables vapor to escape the cylinder block water jacket during engine operation.

Figure 1:
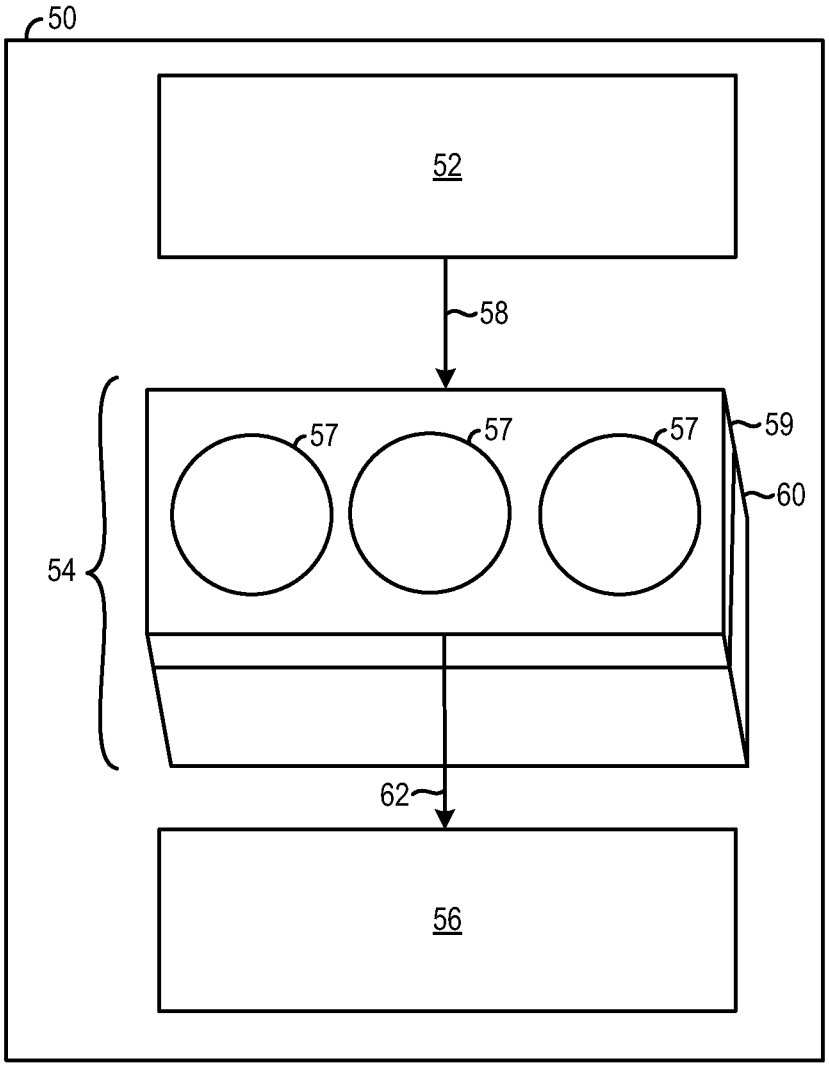
FIG. 1 shows a schematic depiction of a vehicle having an engine including a molded composite cylinder block assembly attached to a cylinder head.

FIG. 1 shows a schematic depiction of a vehicle 50 including an intake system 52, an engine 54, and an exhaust system 56. The intake system 52 is configured to provide intake air to cylinders 57 in the engine 54. The cylinders may also be referred to as combustion chambers. Arrow 58 denotes the fluidic communication between the intake system 52 and the engine 54. Specifically, the intake system 52 may be configured to provide intake air to each of the cylinders in the engine. The intake system 52 may include various intake conduits, an intake manifold, a throttle, etc. Furthermore, a turbocharger including a compressor and a turbine may be included in the engine 54, in one example.

The engine 54 includes a cylinder head 59 coupled to a molded cylinder block assembly 60 forming the plurality of cylinders 57. In the depicted example, the engine includes 3 cylinders in an inline configuration. However, alternate cylinder arrangements and cylinder quantities have been contemplated. For instance, the cylinders may be arranged in banks in a V-type configuration, cylinder arranged in a horizontally opposed configuration, etc. A multi-stroke combustion cycle may be implemented. For instance, four or two stroke combustion cycles have been contemplated. It will be appreciated that the engine 54 depicted in FIG. 1 has structural complexity that is not depicted in FIG. 1. Specifically, the molded cylinder block assembly 60 may include a plurality of components which may be constructed out of different materials. For instance, the molded cylinder block assembly 60 and therefore the engine 54 may include a composite cylinder block, a cylinder liner, and one or more bulkhead inserts. The molded cylinder block assembly components are described in greater detail herein with regard to FIGS. 2-6.

Arrow 62 depicts the fluidic communication between the engine 54 and the exhaust system 56. It will be appreciated that each of the cylinders 57 in the engine 54 may be in fluidic communication with the exhaust system 56. The exhaust system 56 may include a plurality of components such as an exhaust manifold, emission control devices (e.g., catalysts, filters, etc.), mufflers, etc.

Figure 2:
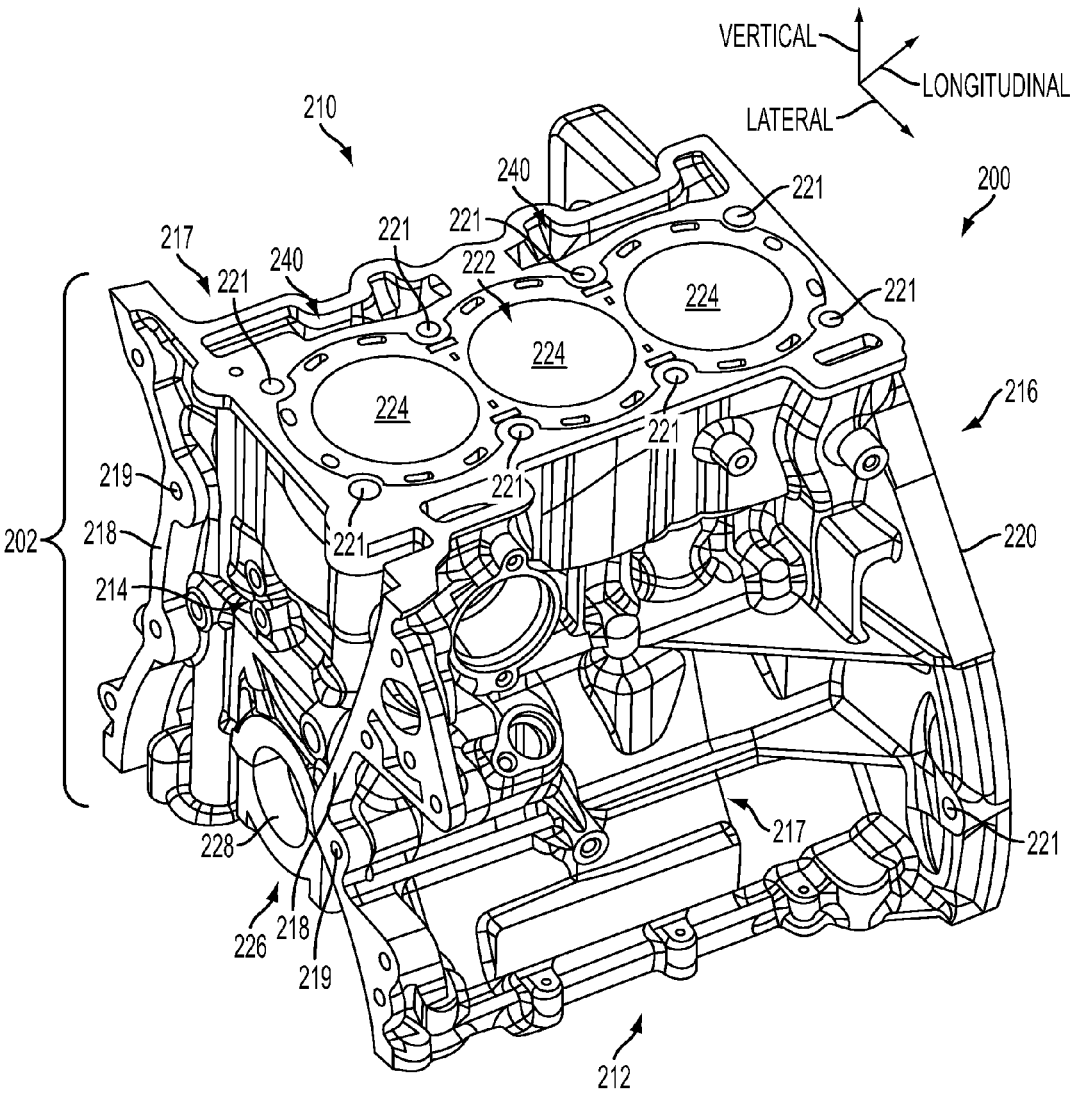
FIG. 2 shows a first example molded cylinder block assembly.

FIG. 2 shows a first example molded cylinder block assembly 200. The molded cylinder block assembly 200 may be similar to the molded cylinder block assembly 60 shown in FIG. 1 and therefore may be included in the engine 54. The molded cylinder block assembly 200 includes a composite cylinder block 202. A number of suitable manufacturing methods may be used to construct the composite cylinder block 202. For instance, the composite cylinder block may be constructed via a thermal setting technique such as injection molding. Therefore, the composite cylinder block 202 may be specifically referred to as a thermal-set composite cylinder block, in one example. The manufacturing methods for the composite cylinder block 202 are described in greater detail herein with regard to FIG. 7.

Suitable materials used to construct the composite cylinder block may include a polymeric material such as a thermal-set resin, carbon fiber, etc. It will be appreciated that plastic resin may be less expensive than carbon fiber. The composite material may be thermally stable when exposed to heat generated from combustion operation. For instance, the composite material may be thermally stable when operating in a temperature range between 120° C. and 200° C., in one example. Furthermore, the composite material may also have a desired stiffness and strength to handle stresses and strains generated in the engine or by other vehicle components, such as the transmission. It will be appreciated that constructing a portion of the engine out of a composite material enables a material with a high strength to weight ratio to be used in selected areas of the engine where favorable abrasive and thermal characteristics may not be necessitated. In this way, different sections of the engine may be tuned to achieve different end-use characteristics to increase the engine's strength to weight ratio and the engine's longevity.

The composite cylinder block 202 includes a top side 210, a bottom side 212, a front side 214, a rear side 216, and two lateral sides 217. A front engine cover attachment interface 218 having attachment openings 219 is shown included in the front side 214. The attachment interface 218 may be coupled to a front engine cover. Additionally, the rear side 216 includes a transmission bell housing interface 220. The transmission bell housing interface 220 may be coupled to a transmission bell housing included a transmission via attachment openings 221 configured to receive an attachment apparatus. The transmission may be coupled to a crankshaft coupled to pistons in the engine. The composite cylinder block includes cylinder head attachment openings 221. The cylinder head attachment openings 221 are configured to attach to bolts or other suitable attachment apparatuses extending from a cylinder head, such as the cylinder head 59 shown in FIG. 1. In one example, metal support structures may be positioned adjacent to the attachment interface 218 and/or the transmission bell housing interface 220. Thus, the metal support structures may be at least partially enclosed via the composite cylinder block 202. In this way, additional support may be provided to selected areas of the molded composite cylinder block assembly.

Continuing with FIG. 2, the molded cylinder block assembly 200 further includes a cylinder liner 222. The cylinder liner 222 forms a continuous piece of material, in the depicted example. Additionally, the cylinder liner 222 defines a portion of the boundary of a plurality of cylinders 224. The cylinder liner may comprise a metal (e.g., powdered metal) such as iron (e.g., graphite iron), aluminum, etc.).

Additionally, the molded cylinder block assembly 200 further includes a plurality bulkhead inserts 226. A single bulkhead insert is shown in FIG. 2. However, the assembly includes four bulkhead inserts, in the depicted example. Furthermore, each of the bulkhead inserts 226 includes a bearing cap 228. The bearing cap 228 may enclose a crankshaft bearing. Thus, the number of bulkhead inserts in the molded cylinder block assembly is greater than the number of cylinders in the assembly, in the depicted example. However, cylinder block assemblies with a different number of bulkhead inserts have been contemplated. For instance, only a single bulkhead insert may be included in the molded cylinder block assembly 200. The bulkhead inserts 226 extend (e.g., vertically extend) through the composite cylinder block 202. A vertical axis is provided for reference. However, other relative dimensions may be used if desired. Longitudinal and lateral axes are also provided for reference in FIG. 2. The bulkhead inserts 226 may be coupled to a cylinder head, such as the cylinder head 59 shown in FIG. 1. In this way, the bulkhead inserts ties combustion loads travelling through the head bolts with reactive loads from the crankshaft bearing caps. The bulkhead inserts 226 and cylinder liner 222 is shown in greater detail in FIG. 3.

Continuing with FIG. 2, the composite cylinder block 202 and the cylinder liner 222 may be constructed out of different materials. For instance, the composite cylinder block 202 may be constructed out of a thermal-set material such as a polymeric material (e.g., a plastic resin) and/or carbon fiber. On the other hand, the cylinder liner may be constructed out of a metal (e.g., powdered metal) such as iron, aluminum, etc. The cylinder liner 222 bore walls may also be coated with a material such as iron/iron-oxide plasma spray deposition coating known as PTWA for wear resistance and increased longevity. The aluminum cylinder liner 222 may also have a traditional cast iron sleeve as part of its structure to withstand higher combustion pressures. These liner combinations for materials used are chosen based on engine application of combustion method such as natural aspirated or boosted induction systems. Additionally, the composite cylinder block 202 and the bulkhead inserts 226 may be constructed out of different materials. For instance, the bulkhead inserts 226 may be constructed out of a metal such as CGI iron, powder metal, aluminum, etc. Additionally, the bulkhead inserts 226 and the cylinder liner 222 may be constructed out of different materials in one example or the same material in other examples stated herein for engine system applications for resolving durability and longevity issues.

The composite cylinder block 202 includes cylinder head oil drain back channel and cavities 240. The two cylinder head oil drain back cavities 240 as an example may be in fluidic communication with the oil retuning from the cylinder head back down into the oil pan in a separate channel or cavities surrounding the cylinder liner 222 yet separated by composite material forming cylinder block 202, discussed in greater detail herein with regard to FIG. 2.

Figure 3:
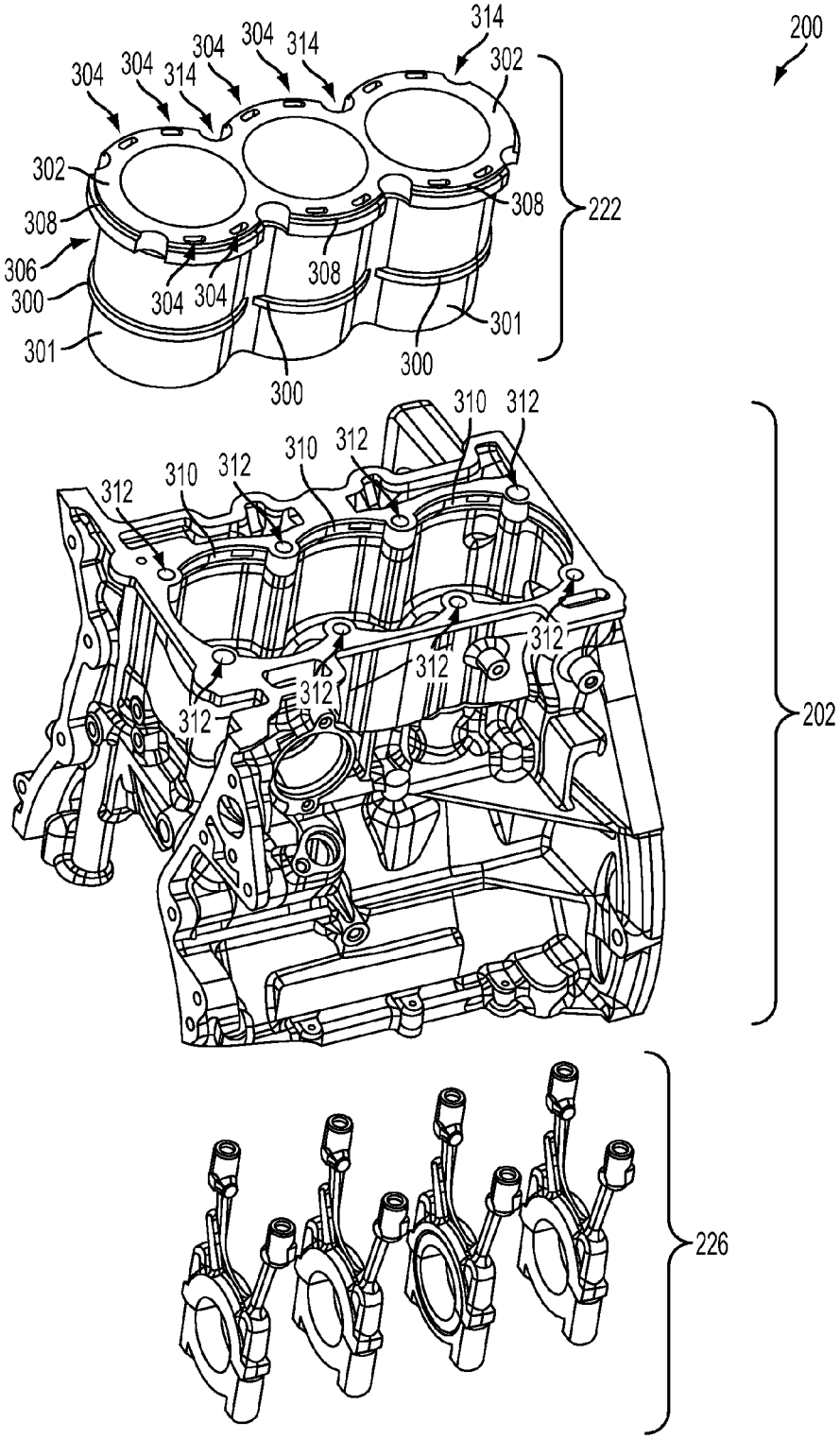
FIG. 3 shows an exploded view of the molded cylinder block assembly illustrated in FIG. 2.

FIG. 3 shows an exploded view of the molded cylinder block assembly 200 shown in FIG. 2. Each of the cylinder liner 222, the composite cylinder block 202, and the bulkhead inserts 226 are depicted. It will be appreciated that both the cylinder liner 222 and the bulkhead inserts 226 are at least partially enclosed by the composite cylinder block 202 when assembled. Moreover, the bulkhead inserts 226 may extend vertically through the composite cylinder block 202 all the way or partially up to the top deck face 302.

The cylinder liner 222 includes a block attachment lip 300. The block attachment lip 300 extends around a peripheral surface 301 of the cylinder liner 222. The block attachment lip 300 is in face sharing contact with a portion of the composite cylinder block 202. Therefore, the composite cylinder block may be directly molded to the cylinder liner 222. The block attachment lip 300 enables stronger connection to be formed between the cylinder liner and the composite cylinder block. In one example, the block attachment lip 300 may continuously extend around the cylinder liner 222 uninterrupted. However in other examples, the block attachment lip may be segmented. In one example, the block attachment lip 300 may define a boundary (e.g., lower boundary) of the water jacket cavity. In this way, the water jacket may be separated from oil in a crankcase positioned below the block.

The cylinder liner 222 also includes a top deck 302. In the depicted example, an outer surface of the top deck 302 is planar. However, other top deck contours have been contemplated. Furthermore, the top deck 302 may be in face sharing contact with a cylinder head, such as the cylinder head 59 shown in FIG. 1. The top deck 302 includes a plurality of openings 304. The openings 304 may be in fluidic communication with the water jacket cavities 306 surrounding the cylinders. It will be appreciated that the water jacket cavities 306 may be in fluidic communication with an engine cooling system configured to flow coolant through cavities and passages in the cylinder block.

The openings 304 enable filler material (e.g., wax, salt) defining the boundary of the water jacket cavity 306 to flow out of the cavity during manufacturing. In this way, the filler material may be placed around the cylinder liner during molding, to create water jacket cavity 306. Therefore, precise water flow characteristics may be provided via the geometry of the filler material (e.g., wax liner, salt core). As a result, the heat transfer characteristics in the cylinder block may be improved. It will be appreciated that the filler material may be placed around the cylinder liner 222 during molding of the composite cylinder block 202. The manufacturing method of the molded cylinder block assembly is described in greater detail herein with regard to FIG. 7.

The cylinder liner 222 is formed out of a single continuous piece of material, in the depicted example. However other cylinder liner configurations have been contemplated. For instance, a cylinder liner having two or more sections spaced away from one another may be utilized in other examples.

The cylinder liner 222 further includes block attachment recesses 308 included in the top deck 302. When the cylinder block assembly 200 is assembled, the block attachment recesses 308 is in face sharing contact with an attachment extension 310 in the composite cylinder block 202. This attachment also increases the connection strength between the cylinder liner 222 and the composite cylinder block 202. The block attachment recesses 308 are positioned above the block attachment lip 300, in the depicted example. Therefore, the block attachment lip is positioned below the recesses. However, other arrangements of the lip and recesses have been contemplated.

The composite cylinder block 202 includes head attachment openings 312 configured to receive attachment apparatuses from a cylinder head, such as the cylinder head 59 shown in FIG. 1. When the cylinder block assembly is assembled, the head attachment openings 312 are mated with depressions 314 in the cylinder liner 222. The attachment openings 312 are coupled to the bulkhead inserts 226. A more detailed view of the bulkhead inserts is shown in FIG. 4.

Figure 4:
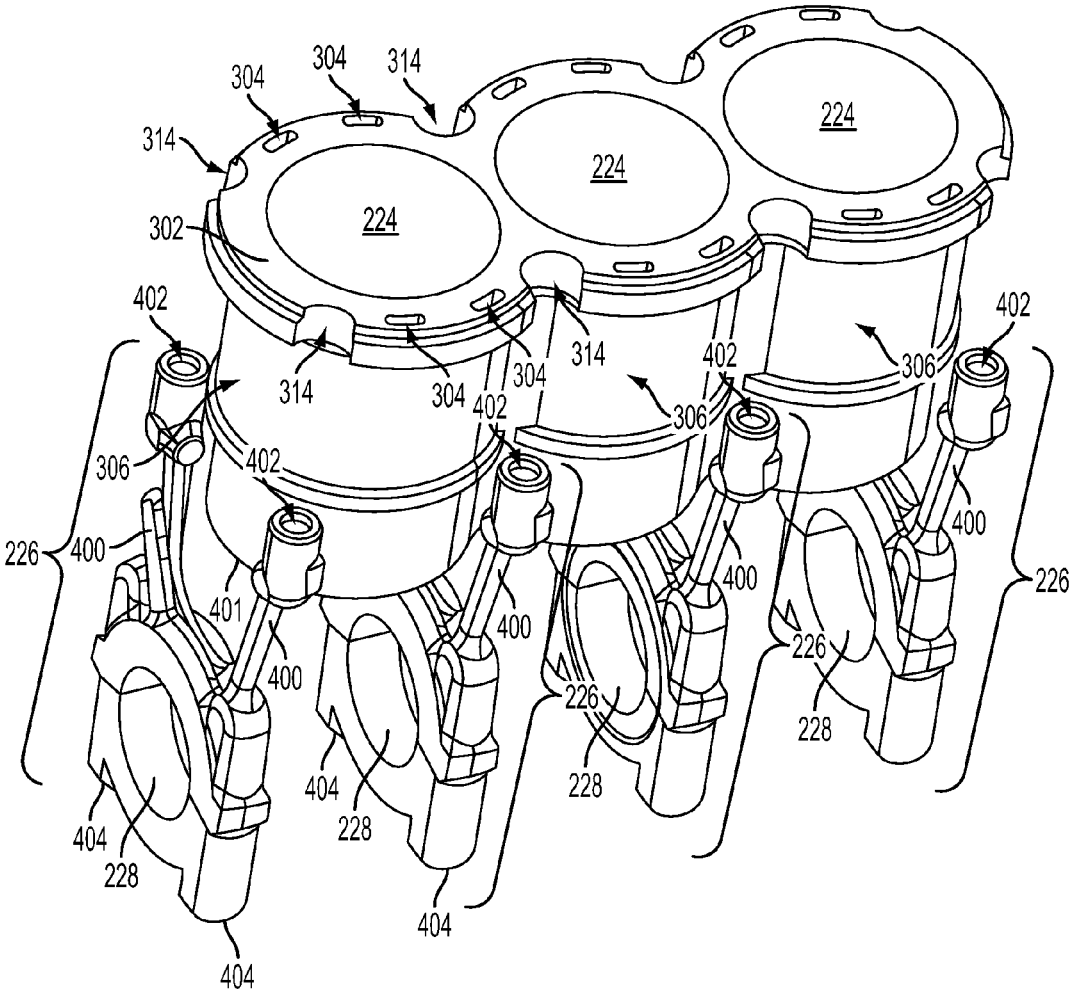
FIG. 4 shows the cylinder liner and bulkhead inserts in the molded cylinder block assembly illustrated in FIG. 2.

FIG. 4 show a detailed view of the cylinder liner 222 and the bulkhead inserts 226 shown in FIG. 2. The cylinder liner 222 defines a portion of the boundaries of the cylinders 224. It will be appreciated that a portion of a cylinder head may define the other portion of the boundaries of the cylinders 224. Each of the bulkhead inserts 226 includes two supports 400 extending (e.g., vertically extending) through the composite cylinder block 202, shown in FIGS. 2 and 3. Specifically, the supports extend above a bottom 401 of the cylinders 224.

Each of the supports 400 includes an opening 402 which may be coupled (e.g., directly coupled) to an attachment apparatus extending from a cylinder head, such as the cylinder head 59 shown in FIG. 1. Coupling the bulkhead inserts 226 to the cylinder head enables the forces generated by the crankshaft to be more evenly distributed throughout the engine, thereby reducing the likelihood of fractures, bending, etc, of engine components. Additionally, sections of the supports 400 are positioned on either lateral sides of the cylinder liner 222. In this way, the bulkhead inserts can extend through the composite cylinder block past a portion of the cylinder liner. Each of the supports 400 is spaced away from the outer wall of the water jacket cavities 306.

As previously discussed each of the bulkhead inserts 226 includes a bearing cap 228. The bearing caps 228 are configured to enclose a crankshaft bearing. The crankshaft bearings enabling supported rotation of a crankshaft. The bearing caps 228 may be cracked to facilitated installation of the crankshaft bearings and the crankshaft. Openings 404 in the bottom of the bearing caps 228 are configured to receive attachment apparatuses. For instance, the bearing caps 228 may be cracked to enable crankshaft installation. Therefore, attachment apparatuses may extend through the openings 404 to attach the cracked portion of the bearing cap to the bulkhead insert to enable attachment of the crankshaft and the crankshaft bearings.

Again the depressions 314 in the cylinder liner 222 are shown in FIG. 4. The top deck 302 including the openings 304 are also shown in FIG. 4. Water jacket cavities 306 may also extend around the cylinder liner 222. It will be appreciated that a portion of the boundary of the water jacket cavities 306 may be defined by an interior surface of the composite cylinder block 202 shown in FIGS. 2 and 3.

Figure 5:
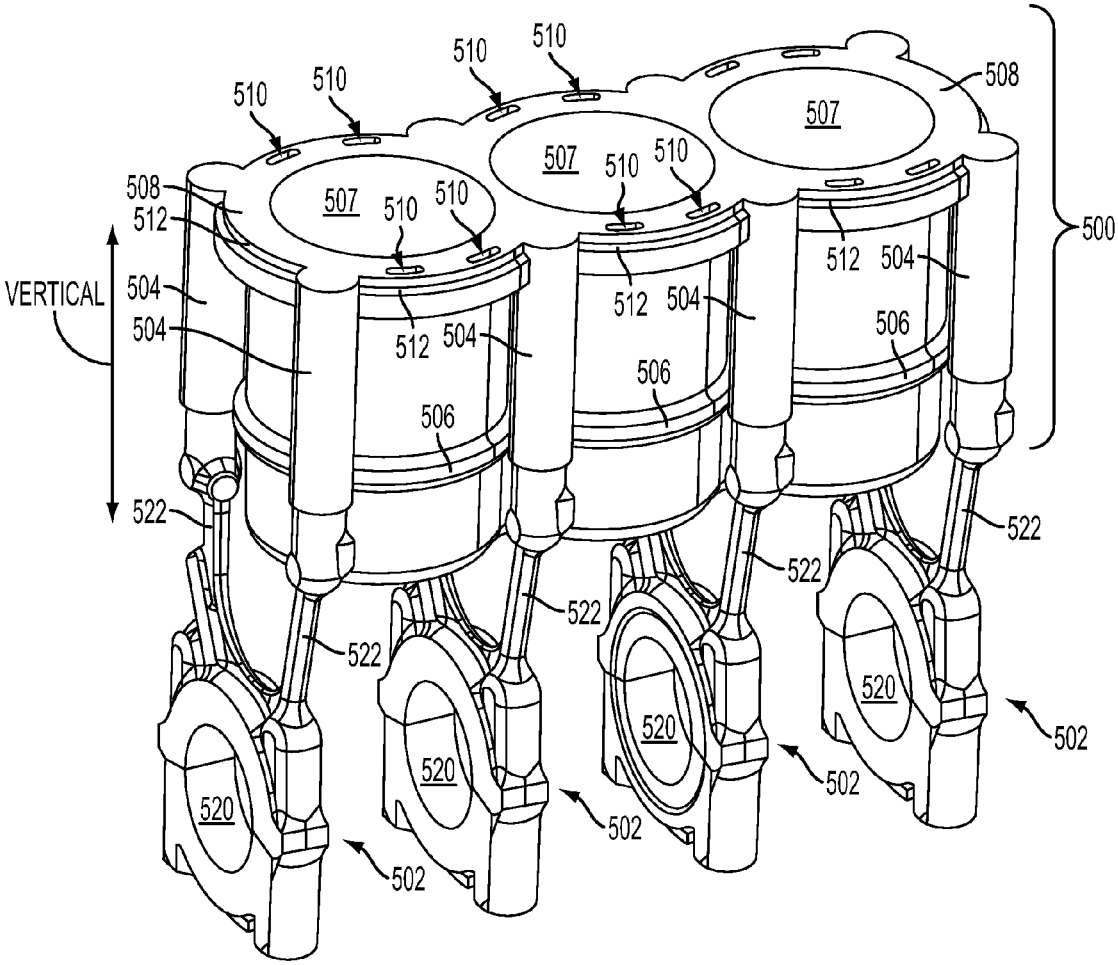
FIG. 5 shows another example cylinder liner and bulkhead inserts which may be included in the molded cylinder block assembly shown in FIG. 2.
Figure 6:
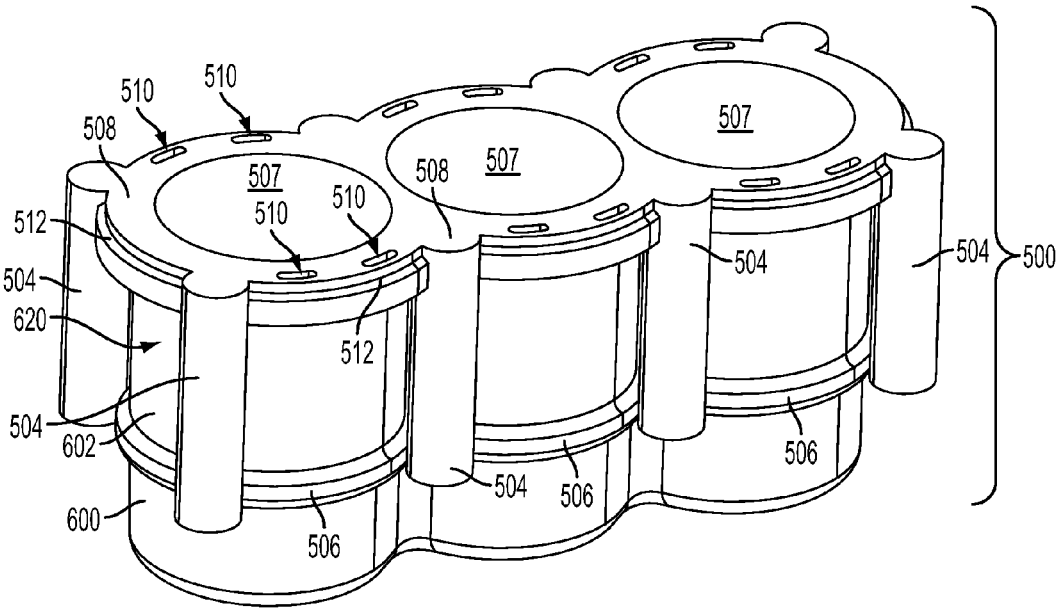
FIG. 6 shows the cylinder liner depicted in FIG. 5.

FIGS. 5 and 6 show a second example cylinder liner 500 and bulkhead inserts 502. It will be appreciated that the cylinder liner 500 and the bulkhead inserts 502 shown in FIGS. 5 and 6 may be included in molded cylinder block assembly including a composite cylinder block, such as the molded cylinder block assembly 60 shown in FIG. 1. Further it will be appreciated that a composite cylinder block may at least partially enclose the cylinder liner and bulkhead inserts shown in FIGS. 5 and 6. In other words, the cylinder liner 500 and bulkhead inserts 502 may be integrally molded in a composite cylinder block.

Specifically, FIG. 5 shows an assembled view of the cylinder liner 500 and the bulkhead inserts 502. The cylinder liner 500 includes a plurality of attachment columns 504. The attachment columns extend (e.g., vertically extend) down to cylinder liner to the block attachment lip 506 from a top deck 508. A vertical axis is provided for reference. It will be appreciated that the block attachment lip 506 may be in face sharing contact with a portion of a composite cylinder block, such as the composite cylinder block shown in FIG. 2.

The attachment columns 504 are configured to attach to a cylinder head, such as the cylinder head 59 shown in FIG. 1. In other examples, one or more of the attachment columns may include attachment openings configured to receive an attachment apparatus (e.g., bolts, pins, etc.,) extending from a cylinder head, such as the cylinder head 59 shown in FIG. 1. The bulkhead inserts 502 shown in FIG. 5 have a similar geometry to the bulkhead inserts shown in FIGS. 2-4. Thus, the bulkhead inserts 502 include bearing caps 520 and supports 522. The bulkhead insert 502 also includes openings at the top of the supports that are hidden from view in the depicted example. As discussed above with regard to FIG. 4, the openings are configured to attach to attachment apparatuses (e.g., bolts, pins, etc.) extending from a cylinder head.

The cylinder liner 500 shown in FIG. 5 also defines a portion of the boundary of a plurality of cylinders 507. The cylinder liner 500 also includes the top deck 508 having openings 510. The top deck 508 further includes block attachment recesses 512. The block attachments recesses may be in face sharing contact with a portion of a composite cylinder block, such as the composite cylinder block shown in FIG. 2. The top deck 508 may extend across a portion of a water jacket cavity at least partially surrounding one or more of the cylinders 507.

FIG. 6 shows the cylinder liner 500 depicted in FIG. 5. The attachment columns 504 are again depicted. As previously discussed the attachment columns 504 extend from the top deck 508 to a block attachment lip 506. As discussed above, the top deck 508 including the openings 510 and the block attachment recesses 512. The cylinders 507 are also shown in FIG. 6. In one example, a water jacket cavity 620 may surround the cylinder liner and specifically the attachment columns 504.

The cylinder liner 500 shown in FIG. 6 may include external surfaces having different degrees of roughness. A surface having a greater roughness may increase the coupling strength between the composite cylinder block and the cylinder liner. For instance, an external surface 600 of the cylinder liner 500 below the block attachment lip 506 may have a greater roughness than a surface 602 of the cylinder liner above the block attachment lip 506. It will be appreciated that the surface 602 may define a boundary of the water jacket cavity 620. In this way, selected surfaces on the cylinder liner may have varying degrees of roughness to provide a desired amount of coupling strength in different regions of the cylinder liner.

Figure 7:
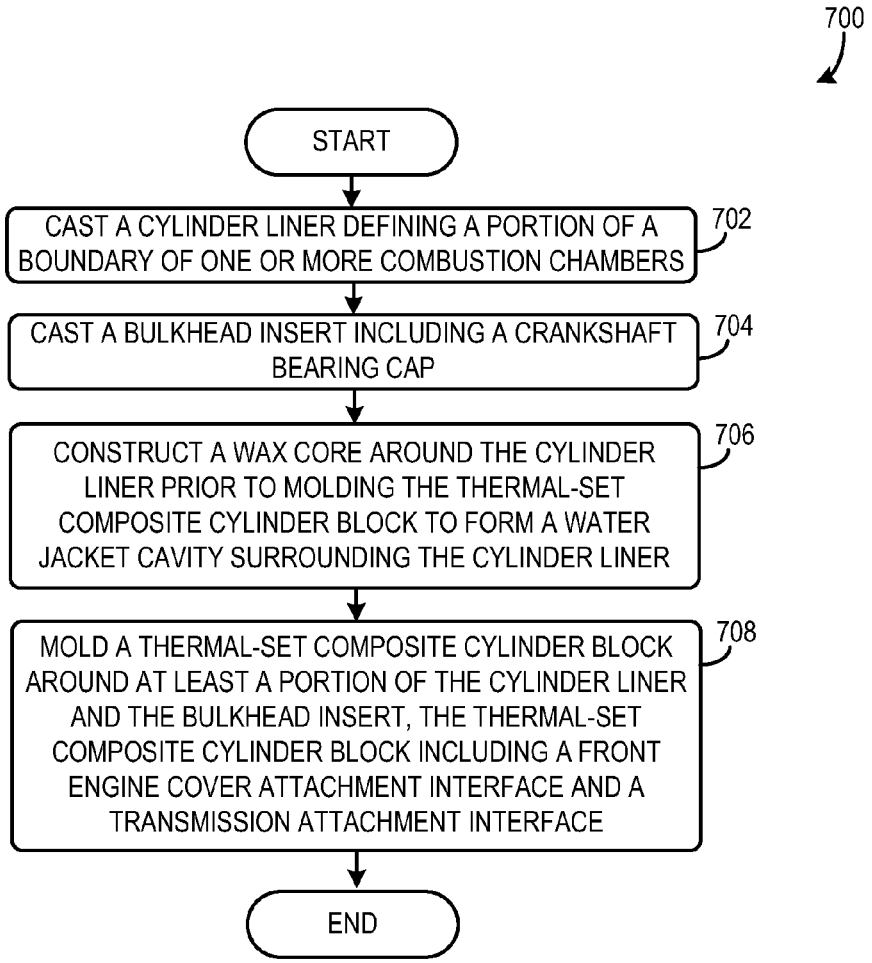
FIG. 7 shows a method for manufacturing an engine.

FIG. 7 shows a method 700 for manufacturing an engine. The method may be used to manufacture the engine discussed above with regard to FIGS. 1-6 or may be used to manufacture another suitable engine.

At 702 the method includes casting a cylinder liner defining a portion of a boundary of one or more combustion chambers. Next at 704 the method includes casting a bulkhead insert including a crankshaft bearing cap. At 706 the method includes construct a wax core around the cylinder liner prior to molding the thermal-set composite cylinder block to form a water jacket cavity surrounding the cylinder liner. Next at 708 the method includes molding a thermal-set composite cylinder block around at least a portion of the cylinder liner and the bulkhead insert, the thermal-set composite cylinder block including a front engine cover attachment interface and a transmission attachment interface. It will be appreciated that the wax core defining the boundary of the water jacket cavity may flow out of openings in the cylinder liner during molding. In this way, the filler material may be easily removed.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine comprising:

a thermo-molded composite cylinder block including a front engine cover attachment interface and a transmission attachment interface;

a cylinder liner comprising a different material than the composite cylinder block and integrally molded with the composite cylinder block, the cylinder liner defining a portion of a boundary of a cylinder and including a top deck at least partially extending across a water jacket cavity at least partially surrounding a cylinder wall; and a bulkhead insert at least partially extending through the composite cylinder block and including at least one head attachment opening, wherein there is an open region formed vertically between the bulkhead insert and the cylinder liner.

2. The engine of claim 1, where the cylinder liner includes attachment columns coupled to the bulkhead insert.

3. The engine of claim 1, where the bulkhead insert includes two supports vertically extending above a bottom of the cylinder, the head attachment opening being located on at least one support at an end nearest to the top deck.

4. The engine of claim 1, where the bulkhead insert comprises a different material than the cylinder liner, and where the bulkhead insert comprises a different material than the composite cylinder block.

5. The engine of claim 1, where an outer surface of the top deck is planar.

6. The engine of claim 1, where the top deck includes one or more openings in fluidic communication with the water jacket cavity.

7. The engine of claim 1, where the top deck includes a block attachment recess in face sharing contact with a portion of the composite cylinder block.

8. The engine of claim 1, where the composite cylinder block includes cylinder head attachment openings mated with depressions in the cylinder liner.

9. The engine of claim 1, where the composite cylinder block comprises a polymeric material.

10. The engine of claim 1, where the composite cylinder block comprises a carbon fiber material.

11. The engine of claim 1, wherein the bulkhead insert is integrally molded with the composite cylinder block.

* * * * *